US010608309B2

(12) United States Patent
Yamane et al.

(10) Patent No.: US 10,608,309 B2
(45) Date of Patent: Mar. 31, 2020

(54) MAGNETORESISTANCE EFFECT DEVICE AND HIGH-FREQUENCY DEVICE

(71) Applicant: TDK CORPORATION, Tokyo (JP)

(72) Inventors: Takekazu Yamane, Tokyo (JP); Junichiro Urabe, Tokyo (JP); Tsuyoshi Suzuki, Tokyo (JP); Atsushi Shimura, Tokyo (JP)

(73) Assignee: TDK CORPORATION, Tokyo (JP)

( * ) Notice: Subject to any disclaimer, the term of this patent is extended or adjusted under 35 U.S.C. 154(b) by 86 days.

(21) Appl. No.: 15/962,587

(22) Filed: Apr. 25, 2018

(65) Prior Publication Data

US 2018/0316077 A1 Nov. 1, 2018

(30) Foreign Application Priority Data

Apr. 27, 2017 (JP) ..... 2017-088449
Mar. 2, 2018 (JP) ..... 2018-037911

(51) Int. Cl.
*H01P 1/218* (2006.01)
*H01P 3/08* (2006.01)
(Continued)

(52) U.S. Cl.
CPC ..... *H01P 1/218* (2013.01); *H01P 3/081* (2013.01); *H01P 5/12* (2013.01); *H01F 10/325* (2013.01);
(Continued)

(58) Field of Classification Search
CPC ..... H01P 1/218; H01P 3/081; H01F 10/329
(Continued)

(56) References Cited

U.S. PATENT DOCUMENTS

2009/0273972 A1* 11/2009 Han ..... B82Y 25/00 365/173
2015/0085569 A1* 3/2015 Nozaki ..... H01L 29/66984 365/158
2017/0244377 A1 8/2017 Yamane et al.

FOREIGN PATENT DOCUMENTS

WO 2007/032149 A1 3/2007

OTHER PUBLICATIONS

Goncalves et al., "Spin torque ferromagnetic resonance with magnetic field modulation", Appl. Phys. Lett. 103, 172406 (2013). (Year: 2013).*

(Continued)

*Primary Examiner* — Benny T Lee
*Assistant Examiner* — Hafizur Rahman
(74) *Attorney, Agent, or Firm* — Oliff PLC

(57) ABSTRACT

A magnetoresistance effect device includes a first port, a second port, a magnetoresistance effect element, a first signal line that is connected to the first port and applies a high-frequency magnetic field to the magnetoresistance effect element, a second signal line that connects the second port to the magnetoresistance effect element, and a direct current application terminal that is connected to a power source configured to apply a direct current or a direct voltage in a lamination direction of the magnetoresistance effect element. The first signal line includes a plurality of high-frequency magnetic field application areas capable of applying a high-frequency magnetic field to the magnetoresistance effect element, and the plurality of high-frequency magnetic field application areas in the first signal line are disposed at positions at which high-frequency magnetic fields generated in the high-frequency magnetic field application areas reinforce each other in the magnetoresistance effect element.

20 Claims, 7 Drawing Sheets

(51) Int. Cl.
*H01P 5/12* (2006.01)
*H01F 10/32* (2006.01)

(52) U.S. Cl.
CPC ..... *H01F 10/329* (2013.01); *H01F 10/3254* (2013.01)

(58) Field of Classification Search
USPC ..... 333/204
See application file for complete search history.

(56) References Cited

OTHER PUBLICATIONS

Kalarickal et al., "Ferromagnetic resonance linewidth in metallic thin films: Comparison of measurement methods;" Journal of Applied Physics; vol. 99, May 15, 2006.
Bilzer et al., "Vector network analyzer ferromagnetic resonance of thin films on coplanar waveguides: Comparison of different evaluation methods;" Journal of Applied Physics, vol. 101, Apr. 12, 2007.
Schumacher et al., "Precessional switching of the magnetization in microscopic magnetic tunnel junctions (invited);" Journal of Applied Physics, vol. 93; No. 10, May 15, 2003.
Beaujour et al., "Ferromagnetic resonance study of polycrystalline cobalt ultrathin films;" Journal of Applied Physics, vol. 99, Apr. 17, 2006.
K. Konishi, et al., "Radio-frequency amplification property of the MgO-based magnetic tunnel junction using field-induced ferromagnetic resonance", Appl. Phy. Lett. 102, 162409 (Apr. 25, 2013).

* cited by examiner

MAGNETORESISTANCE EFFECT DEVICE AND HIGH-FREQUENCY DEVICE

BACKGROUND OF THE INVENTION

Field of the Invention

The invention relates to a magnetoresistance effect device and a high-frequency device.

Priority is claimed on Japanese Patent Application No. 2017-088449, filed on Apr. 27, 2017, and Japanese Patent Application No. 2018-037911, filed on Mar. 2, 2018, the contents of which are incorporated herein by reference.

Description of Related Art

With recent enhancement in functionality of mobile communication terminals such as mobile phones, increase in communication speed of radio communications has progressed. Since a communication speed is proportional to a frequency bandwidth used, frequency bands required for communications have increased. With this increase, the number of high-frequency filters which are required for mobile communication terminals has increased.

Recently, in this field, spintronics have been studied for application to new high-frequency components. A ferromagnetic resonance phenomenon using a magnetoresistance effect element has attracted attention (see J. M. L. Beaujour et al., Journal of Applied Physics 99, 08 N503, (2006)).

Ferromagnetic resonance can be caused in a magnetoresistance effect element by causing an alternating current to flow in the magnetoresistance effect element and applying a magnetic field thereto using a magnetic field application mechanism at the same time. When ferromagnetic resonance is caused, a resistance value of the magnetoresistance effect element fluctuates periodically at a frequency corresponding to a ferromagnetic resonance frequency. The ferromagnetic resonance frequency of the magnetoresistance effect element varies depending on the intensity of the magnetic field applied to the magnetoresistance effect element, and the resonance frequency is generally in a high frequency band of several to several tens of GHz.

SUMMARY OF THE INVENTION

As described above, high-frequency oscillation elements using a ferromagnetic resonance phenomenon have been studied. However, other applications of a ferromagnetic resonance phenomenon have not been satisfactorily specifically studied yet.

The invention is made in consideration of the above-mentioned problem and provides a magnetoresistance effect device that serves as a high-frequency device such as a high-frequency filter using a ferromagnetic resonance phenomenon.

In order to solve the above-mentioned problem, a method of using a magnetoresistance effect device using a ferromagnetic resonance phenomenon as a high-frequency device has been studied. As a result, a magnetoresistance effect device using a variation of a resistance value of a magnetoresistance effect element which is generated due to the ferromagnetic resonance phenomenon was found and this magnetoresistance effect device was found to serve as a high-frequency device.

In order to improve output characteristics of a high-frequency device, it is preferable that a variation of a resistance value of a magnetoresistance effect element be increased by efficiently applying a high-level high-frequency magnetic field to a magnetoresistance effect element. Therefore, a configuration of a magnetoresistance effect device that can efficiently apply a high-level high-frequency magnetic field to a magnetoresistance effect element was found.

That is, the invention provides the following means to solve the above-mentioned problem.

(1) A magnetoresistance effect device, including: a first port configured for a signal to be input; a second port configured for a signal to be output; a magnetoresistance effect element including a first ferromagnetic layer, a second ferromagnetic layer, and a spacer layer that is interposed between the first ferromagnetic layer and the second ferromagnetic layer; a first signal line which is connected to the first port, a high frequency current corresponding to the signal input from the first port flowing through the first signal line, and the first signal line being configured to apply a high frequency magnetic field to the magnetoresistance effect element; a second signal line that connects the second port and the magnetoresistance effect element to each other; and a direct current application terminal that is capable of being connected to a power supply configured to apply a direct current or a direct current voltage in a lamination direction of the magnetoresistance effect element, wherein the first signal line includes a plurality of high-frequency magnetic field application areas capable of applying a high-frequency magnetic field to the magnetoresistance effect element, and the plurality of high-frequency magnetic field application areas in the first signal line are disposed at positions at which high-frequency magnetic fields generated in the high-frequency magnetic field application areas reinforce each other in the magnetoresistance effect element.

(2) In the magnetoresistance effect device according to the aspect, the first signal line may surround the magnetoresistance effect element as the magnetoresistance effect element being viewed in a predetermined direction, and at least two high-frequency magnetic field application areas of the plurality of high-frequency magnetic field application areas may be located at positions facing each other with respect to the magnetoresistance effect element.

(3) In the magnetoresistance effect device according to the aspect, the first signal line may be wound around an axis extending in the predetermined direction through the magnetoresistance effect element.

(4) In the magnetoresistance effect device according to the aspect, the first signal line may branch into a plurality of signal lines, and all the signal lines in which a high-frequency current flows in a same direction among the plurality of branched signal lines may be disposed on a same surface side of the magnetoresistance effect element.

(5) In the magnetoresistance effect device according to the aspect, a part of the first signal line may be configured to double as an upper electrode or a lower electrode configured to apply a direct current or a direct voltage input from the direct current application terminal in the lamination direction of the magnetoresistance effect element.

(6) In the magnetoresistance effect device according to the aspect, a resistance value of the magnetoresistance effect element may be 20 Ω or more.

(7) The magnetoresistance effect device according to the aspect may further include a magnetic field application mechanism configured to apply an external magnetic field to the magnetoresistance effect element and to modulate a resonance frequency of the magnetoresistance effect element.

(8) A high-frequency device according to a second aspect employs the magnetoresistance effect device according to the aspect.

With the magnetoresistance effect device according to the aspects, it is possible to use the magnetoresistance effect device using a ferromagnetic resonance phenomenon as a high-frequency device such as a high-frequency filter or an amplifier.

With the magnetoresistance effect device according to the aspect, it is possible to efficiently apply a high-level high-frequency magnetic field to the magnetoresistance effect element.

DETAILED DESCRIPTION OF THE INVENTION

Figure 1:
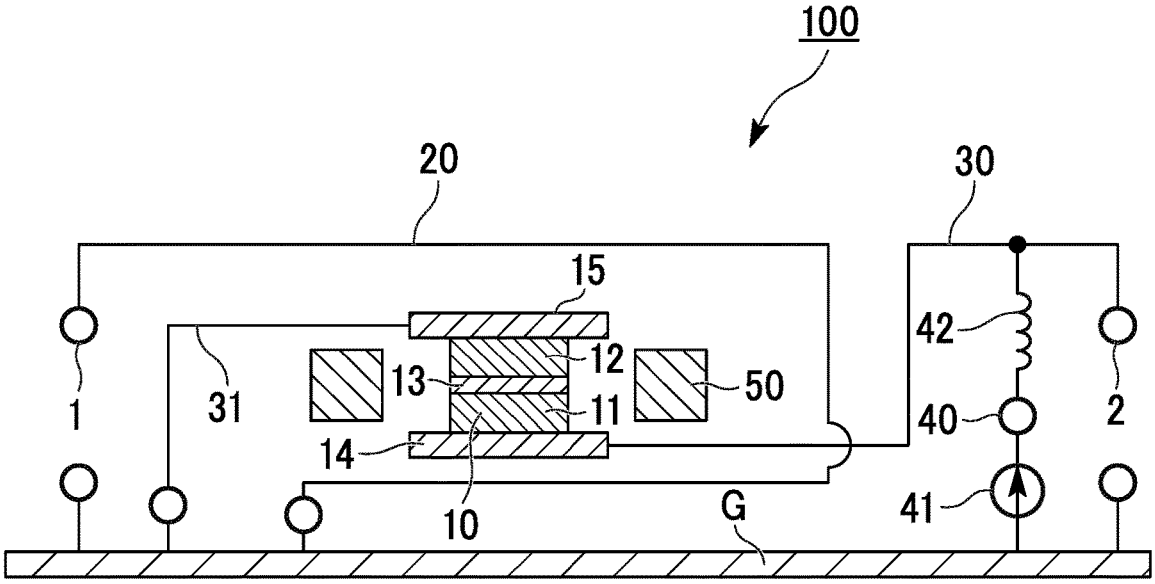
FIG. 1 is a schematic diagram of a magnetoresistance effect device according to a first embodiment.

Hereinafter, a magnetoresistance effect device will be described in detail with reference to the accompanying drawings. In the drawings which are used in the following description, characteristic parts may be enlarged for the purpose of convenience and dimensional proportions of elements or the like may be different from actual values. Materials, dimensions, and the like which are described in the following description are examples, and the invention is not limited thereto and can be appropriately modified within a range in which advantages of the invention are achieved.

(First Embodiment)

FIG. 1 is a schematic diagram illustrating a circuit configuration of a magnetoresistance effect device according to a first embodiment. The magnetoresistance effect device 100 illustrated in FIG. 1 includes a first port 1, a second port 2, a magnetoresistance effect element 10, a first signal line 20, a second signal line 30, a third signal line 31, a direct current application terminal 40, and a magnetic field application mechanism 50.

<First Port and Second Port>

The first port 1 is an input terminal of the magnetoresistance effect device 100. The first port 1 corresponds to one end of the first signal line 20. An alternating-current signal can be applied to the magnetoresistance effect device 100 by connecting an alternating current signal source (not illustrated) to the first port 1.

The second port 2 is an output terminal of the magnetoresistance effect device 100. The second port 2 corresponds to one end of the second signal line 30. A signal output from the magnetoresistance effect device 100 can be measured by connecting a high-frequency measuring instrument (not illustrated) to the second port 2. For example, a network analyzer can be used as the high-frequency measuring instrument.

<Magnetoresistance Effect Element>

The magnetoresistance effect element 10 includes a first ferromagnetic layer 11, a second ferromagnetic layer 12, and a spacer layer 13 that is interposed between the first ferromagnetic layer 11 and the second ferromagnetic layer 12. In the following description, the first ferromagnetic layer is defined as a magnetization fixed layer and the second ferromagnetic layer is defined as a magnetization free layer, but the first ferromagnetic layer and the second ferromagnetic layer may serve as either thereof. The magnetization of the magnetization fixed layer 11 has more difficulty in moving than that of the magnetization free layer 12, and is fixed to one direction under an environment of a predetermined magnetic field. The magnetization direction of the magnetization free layer 12 varies relative to the magnetization direction of the magnetization fixed layer 11 and thus the magnetoresistance effect element 10 functions.

The magnetization fixed layer 11 is formed of a ferromagnetic material. The magnetization fixed layer 11 is preferably formed of a high spin-polarization material such as Fe, Co, Ni, an alloy of Ni and Fe, an alloy of Fe and Co, or an alloy of Fe, Co, and B. A rate of magnetoresistance change of the magnetoresistance effect element 10 increases by using such a material. The magnetization fixed layer 11 may be formed of a Heusler alloy. The thickness of the magnetization fixed layer 11 preferably ranges from 1 nm to 10 nm.

A method of fixing the magnetization of the magnetization fixed layer 11 is not particularly limited. For example, an antiferromagnetic layer may be added to be in contact with the magnetization fixed layer 11 in order to fix the magnetization of the magnetization fixed layer 11. The magnetization of the magnetization fixed layer 11 may be fixed using magnetic anisotropy resulting from a crystal structure, a shape, or the like. FeO, CoO, NiO, $CuFeS_2$, IrMn, FeMn, PtMn, Cr, Mn, or the like can be used for the antiferromagnetic layer.

The magnetization free layer 12 is formed of a ferromagnetic material of which a magnetization direction can be changed by an externally applied magnetic field or spin-polarized electrons.

CoFe, CoFeB, CoFeSi, CoMnGe, CoMnSi, CoMnAl, or the like can be used as a material of the magnetization free layer 12 when an axis of easy magnetization is provided in an in-plane direction perpendicular to a lamination direction in which the magnetization free layer 12 is stacked, and Co, a CoCr-based alloy, a Co multilayered film, a CoCrPt-based alloy, an FePt-based alloy, a SmCo-based alloy or a TbFeCo alloy including a rare earth metal, or the like can be used as a material thereof when the axis of easy magnetization is provided in the lamination direction of the magnetization free layer 12. The magnetization free layer 12 may be formed of a Heusler alloy.

The thickness of the magnetization free layer 12 preferably ranges from about 1 nm to 10 nm. A high spin-polarization material may be interposed between the magnetization free layer 12 and the spacer layer 13. It is possible to obtain a high rate of magnetoresistance change by inserting the high spin-polarization material therebetween.

Examples of the high spin-polarization material include a CoFe alloy and a CoFeB alloy. The thickness of the CoFe alloy or the CoFeB alloy preferably ranges from about 0.2 nm to 1.0 nm.

The spacer layer 13 is a nonmagnetic layer that is interposed between the magnetization fixed layer 11 and the magnetization free layer 12. The spacer layer 13 is a layer formed of a conductor, an insulator, or a semiconductor or a layer in which a current-carrying point formed of conductor is included in an insulator.

For example, the magnetoresistance effect element 10 serves as a tunneling magnetoresistance (TMR) element when the spacer layer 13 is formed of an insulator, and serves as a giant magnetoresistance (GMR) element when the spacer layer 13 is formed of a metal.

When the spacer layer 13 is formed of a nonmagnetic conductive material, a conductive material such as Cu, Ag, Au, or Ru can be used. In order to efficiently use the GMR effect, the thickness of the spacer layer 13 preferably ranges from 0.5 nm to 3.0 nm.

When the spacer layer 13 is formed of a nonmagnetic semiconductor material, a material such as ZnO, $In_2O_3$, $SnO_2$, ITO, $GaO_x$, or $Ga_2O_x$ can be used. In this case, the thickness of the spacer layer 13 preferably ranges from 1.0 nm to 4.0 nm.

When a layer in which a current-carrying point formed of a conductor is included in a nonmagnetic insulator is used as the spacer layer 13, a structure in which a current-carrying point formed of a conductor such as CoFe, CoFeB, CoFeSi, CoMnGe, CoMnSi, CoMnAl, Fe, Co, Au, Cu, Al, or Mg is included in a nonmagnetic insulator formed of $Al_2O_3$ or MgO can be preferably employed. In this case, the thickness of the spacer layer 13 preferably ranges from 0.5 nm to 2.0 nm.

In order to enhance a current-carrying ability to the magnetoresistance effect element 10, it is preferable that an electrode be disposed on both surfaces of the magnetoresistance effect element 10 in the lamination direction thereof. In the following description, the electrode disposed on the bottom of the magnetoresistance effect element 10 in the lamination direction is referred to as a lower electrode 14, and the electrode disposed on the top thereof is referred to as an upper electrode 15. By providing the lower electrode 14 and the upper electrode 15, the second signal line 30 and the third signal line 31 and the magnetoresistance effect element 10 come into surface contact with each other, and a flow of a signal (a current) at any position in the in-plane direction of the magnetoresistance effect element 10 is parallel to the lamination direction.

The lower electrode 14 and the upper electrode 15 are formed of a material having conductivity. For example, Ta, Cu, Au, AuCu, or Ru can be used for the lower electrode 14 and the upper electrode 15.

A cap layer, a seed layer, or a buffer layer may be disposed between the magnetoresistance effect element 10 and the lower electrode 14 or the upper electrode 15. The cap layer, the seed layer, or the buffer layer can be formed of Ru, Ta, Cu, Cr, or a stacked film thereof. The thickness of these layers preferably ranges from about 2 nm to 10 nm.

Regarding the size of the magnetoresistance effect element 10, when the planar shape of the magnetoresistance effect element 10 is a rectangle (which includes a square), the long side thereof is preferably set to about 300 nm or 300 nm or less.

When the planar shape of the magnetoresistance effect element 10 is not a rectangle, a long side of a rectangle which circumscribes the planar shape of the magnetoresistance effect element 10 with a minimum area is defined as the long side of the magnetoresistance effect element 10.

When the long side is about 300 nm which is small, the volume of magnetization free layer 12 is small and a ferromagnetic resonance phenomenon with a high efficiency can be realized. Here, the "planar shape" refers to a shape when viewed in a lamination direction of the layers of the magnetoresistance effect element 10.

<First Signal Line>

One end of the first signal line 20 is connected to the first port 1 and the other end thereof is connected to a reference potential. In FIG. 1, the reference potential is connected to the ground G. A high-frequency current flows in the first signal line 20 depending on a potential difference between a high-frequency signal input to the first port 1 and the ground G. When a high-frequency current flows in the first signal line 20, a high-frequency magnetic field is generated from the first signal line 20. This high-frequency magnetic field is applied to the magnetoresistance effect element 10.

Figure 2:
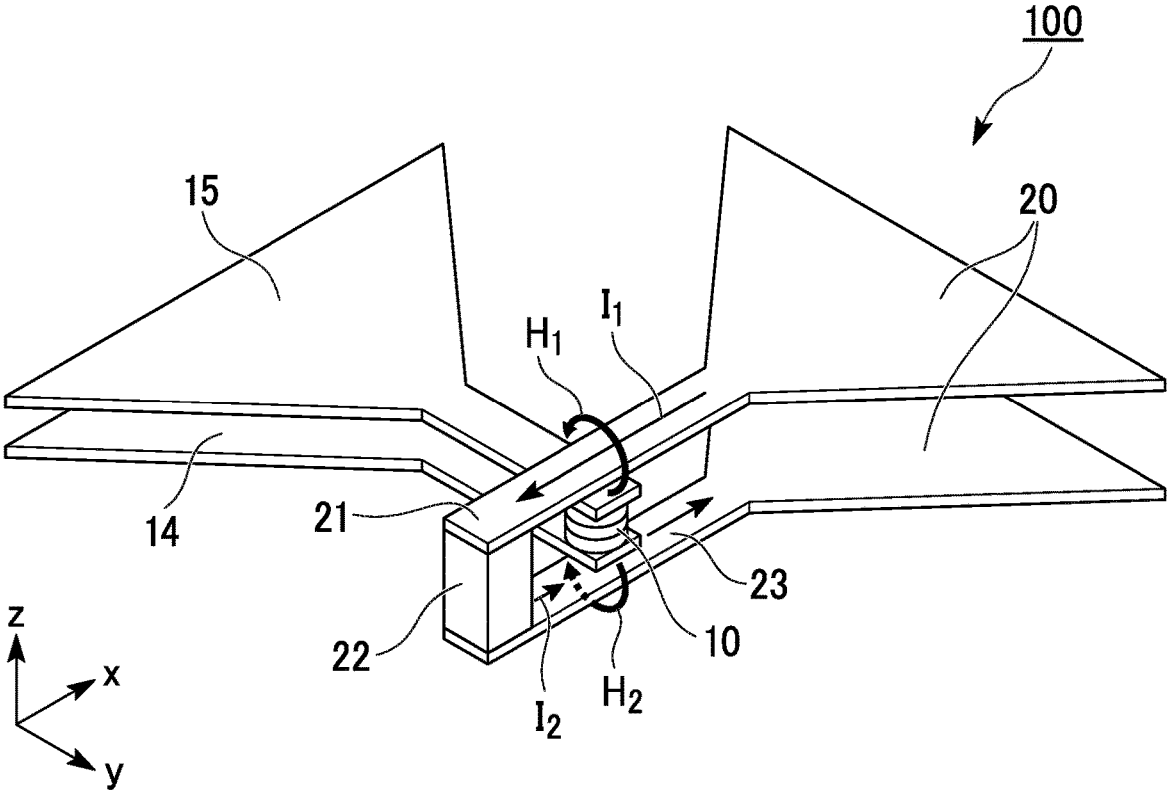
FIG. 2 is a schematic perspective view of the vicinity of a magnetoresistance effect element of the magnetoresistance effect device according to the first embodiment.

FIG. 2 is a schematic perspective view of the vicinity of the magnetoresistance effect element 10 of the magnetoresistance effect device 100 according to the first embodiment. In the following description, a lamination direction of the magnetoresistance effect element 10 is defined as a z direction, one direction in a plane perpendicular to the z direction is defined as an x direction, and a direction perpendicular to the x direction and the z direction is defined as a y direction.

The first signal line 20 illustrated in FIG. 2 includes a first line 21 that extends in the x direction at a position in the +z direction of the magnetoresistance effect element 10, a second line 23 that is disposed at a position facing the first line 21 with the magnetoresistance effect element 10 interposed therebetween, and a via wiring 22 that connects the first line 21 to the second line 23. The first signal line 20 surrounds the magnetoresistance effect element 10 when the magnetoresistance effect element 10 is viewed in the y direction.

A high-frequency current flows in one direction in the first signal line 20. The direction of a high-frequency current $I_1$ flowing in the first line 21 and the direction of a high-frequency current $I_2$ flowing in the second line 23 are antiparallel to each other. Here, the "direction of a high-frequency current" refers to a direction of a current when attention is paid to a certain time point of a high-frequency current which is an alternating current. The high-frequency current $I_1$ flowing in the first line 21 generates a magnetic field $H_1$ with the first line 21 as a central axis. Similarly, the high-frequency current $I_2$ flowing in the second line 23 generates a magnetic field $H_2$ with the second line 23 as a central axis.

The directions of the magnetic field $H_1$ and the magnetic field $H_2$ which are applied to the magnetoresistance effect element 10 are both the +y direction at a certain moment and are both the −y direction at another moment. That is, the magnetic field $H_1$ generated in the first line 21 and the magnetic field $H_2$ generated in the second line 23 overlap each other at the position of the magnetoresistance effect element 10 and reinforce each other.

That is, a plurality of high-frequency magnetic field application areas (the first line 21 and the second line 23 in FIG. 2) that apply a high-frequency magnetic field to the magnetoresistance effect element 10 can be provided by setting the first signal line 20 to a predetermined arrangement relative to the magnetoresistance effect element 10, and a high-level high-frequency magnetic field can be applied to the magnetoresistance effect element 10 by causing the high-frequency magnetic fields to reinforce each other.

<Second Signal Line, Third Signal Line>

One end of the second signal line 30 is connected to the magnetoresistance effect element 10, and the other end thereof is connected to the second port 2. That is, the second signal line 30 connects the magnetoresistance effect element 10 to the second port 2. The second signal line 30 outputs a signal of a frequency, which is selected using ferromagnetic resonance of the magnetoresistance effect element 10, from the second port 2.

One end of the third signal line 31 is connected to the magnetoresistance effect element 10, and the other end thereof is connected to a reference potential. In FIG. 1, the third signal line 31 is connected to the ground G which is common to the reference potential of the first signal line 20, but may be connected to another reference potential. In order to simplify a circuit configuration, it is preferable that the reference potential of the first signal line 20 and the reference potential of the third signal line 31 be common.

The shapes of the signal lines and the ground G are preferably defined as a microstrip line (MSL) type or a coplanar waveguide (CPW) type. When the shapes are designed as a microstrip line (MSL) type or a coplanar waveguide (CPW) type, it is preferable that signal line widths or distances to the ground be designed such that characteristic impedances of the signal lines are equal to impedance of the circuit system. By employing this design, it is possible to curb transmission loss of the signal lines.

<Direct Current Application Terminal>

The direct current application terminal 40 is connected to a power source 41 and applies a direct current or a direct voltage in the lamination direction of the magnetoresistance effect element 10. The power source 41 may be constituted by a combination circuit of a fixed resistor and a direct voltage source that can generate a constant direct current. The power source 41 may be a direct current source or a direct voltage source.

An inductor 42 is disposed between the direct current application terminal 40 and the second signal line 30. The inductor 42 cuts high-frequency components of a current and passes only a DC component of the current. An output signal which is output from the magnetoresistance effect element 10 is made to efficiently flow to the second port 2 by the inductor 42. Since a direct current can pass through the inductor 42, the direct current flows in a closed circuit formed by the direct current source 41, the second signal line 30, the magnetoresistance effect element 10, the third signal line 31, and the ground G.

A chip inductor, an inductor based on a pattern line, a resistance element including an inductance component, or the like can be used as the inductor 42. The inductance of the inductor 42 is preferably 10 nH or more.

<Magnetic Field Application Mechanism>

The magnetic field application mechanism 50 applies an external magnetic field to the magnetoresistance effect element 10 and modulates a resonance frequency of the magnetoresistance effect element 10. A signal output from the magnetoresistance effect device 100 fluctuates depending on the resonance frequency of the magnetoresistance effect element 10. In order to make the output signal variable, it is preferable that a magnetic field application mechanism be additionally provided.

It is preferable that the magnetic field application mechanism 50 be disposed in the vicinity of the magnetoresistance effect element 10. The magnetic field application mechanism 50 is constituted, for example, in an electromagnet type or a strip line type that can variably control an applied magnetic field intensity using one of a voltage and a current. The magnetic field application mechanism may be constituted in combination of an electromagnet type or a strip line type that can variably control an applied magnetic field intensity and a permanent magnet that supplies only a constant magnetic field.

[Function of Magnetoresistance Effect Device]

When a high-frequency signal is input to the magnetoresistance effect device 100 from the first port 1, a high-frequency current corresponding to the high-frequency signal flows in the first signal line 20. The high-frequency current flowing in the first signal line 20 applies a high-frequency magnetic field to the magnetoresistance effect element 10.

As illustrated in FIG. 2, the first signal line 20 includes a plurality of high-frequency magnetic field application areas (the first line 21 and the second line 23) and the high-frequency magnetic fields generated in the high-frequency magnetic field application areas reinforce each other. Accordingly, a high-level high-frequency magnetic field is applied to the magnetoresistance effect element 10.

The magnetization of the magnetization free layer 12 of the magnetoresistance effect element 10 fluctuates greatly when the high-frequency magnetic field applied from the first signal line 20 to the magnetoresistance effect element 10 is located in the vicinity of the ferromagnetic resonance frequency of the magnetization free layer 12. This phenomenon is the ferromagnetic resonance phenomenon.

When fluctuation of the magnetization free layer 12 increases, a change in resistance value of the magnetoresistance effect element 10 increases. The change in resistance value of the magnetoresistance effect element 10 is output as a potential difference between the lower electrode 14 and the upper electrode 15 from the second port 2.

When the high-frequency signal input from the first port 1 is in the vicinity of the resonance frequency of the magnetization free layer 12, the change in the resistance value of the magnetoresistance effect element 10 is large and a high-level signal is output from the second port 2. On the other hand, when the high-frequency signal is separated from the resonance frequency of the magnetization free layer 12, the change in resistance value of the magnetoresistance effect element 10 is small and a signal is not output well from the second port 2. The magnetoresistance effect device 100 serves as a high-frequency filter that can selectively pass only a high-frequency signal of a specific frequency.

The frequency which is selected by the magnetoresistance effect device 100 can be modulated by changing the ferromagnetic resonance frequency of the magnetization free layer 12. The ferromagnetic resonance frequency varies depending on an effective magnetic field in the magnetization free layer 12. The effective magnetic field $H_{eff}$ in the magnetization free layer 12 is expressed by the following equation, where $H_E$ denotes an external magnetic field which is applied to the magnetization free layer 12, $H_k$ denotes an anisotropic magnetic field in the magnetization free layer 12, $H_D$ denotes a demagnetizing field in the magnetization free layer 12, and $H_{EX}$ denotes an exchange coupling magnetic field in the magnetization free layer 12.

$$H_{eff}=H_E+H_k+H_D+H_{EX}$$

Figure 3:
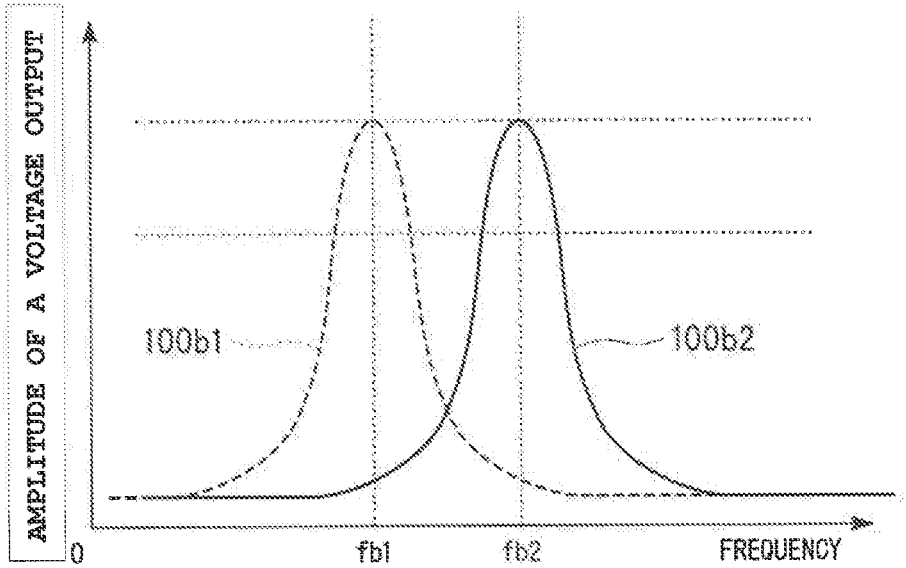
FIG. 3 is a diagram illustrating a relationship between a frequency of a high-frequency signal input to the magnetoresistance effect device and an amplitude of a voltage output therefrom when a direct current applied to the magnetoresistance effect element is constant.

As expressed by the above equation, the effective magnetic field in the magnetization free layer 12 is affected by the external magnetic field $H_E$. The magnitude of the external magnetic field $H_E$ can be adjusted by the magnetic field application mechanism 50. FIG. 3 is a diagram illustrating a relationship between the frequency of a high-frequency signal input to the magnetoresistance effect device 100 and an amplitude of a voltage output therefrom when a direct current applied to the magnetoresistance effect element 10 is constant.

When an arbitrary external magnetic field is applied to the magnetoresistance effect element 10, the ferromagnetic resonance frequency of the magnetization free layer 12 varies by an influence of the external magnetic field. The ferromagnetic resonance frequency at this time is defined as fb 1.

Since the ferromagnetic resonance frequency of the magnetization free layer 12, the amplitude of the output voltage increases when the frequency of the high-frequency signal input to the magnetoresistance effect device 100 is fb 1. Accordingly, the graph of a plotted line 100*b*1 illustrated in FIG. 3 is obtained.

Subsequently, when the applied external magnetic field is increased, the ferromagnetic resonance frequency shifts from fb1 to fb2 due to the influence of the external magnetic field. At this time, the frequency at which the amplitude of the output voltage increases also shifts from fb1 to fb2. As a result, the graph of a plotted line 100*b*2 illustrated in FIG. 3 is obtained. In this way, the magnetic field application mechanism 50 can adjust the effective magnetic field $H_{eff}$ which is applied to the magnetization free layer 12 of the magnetoresistance effect element 10 and modulate the ferromagnetic resonance frequency.

Figure 4:
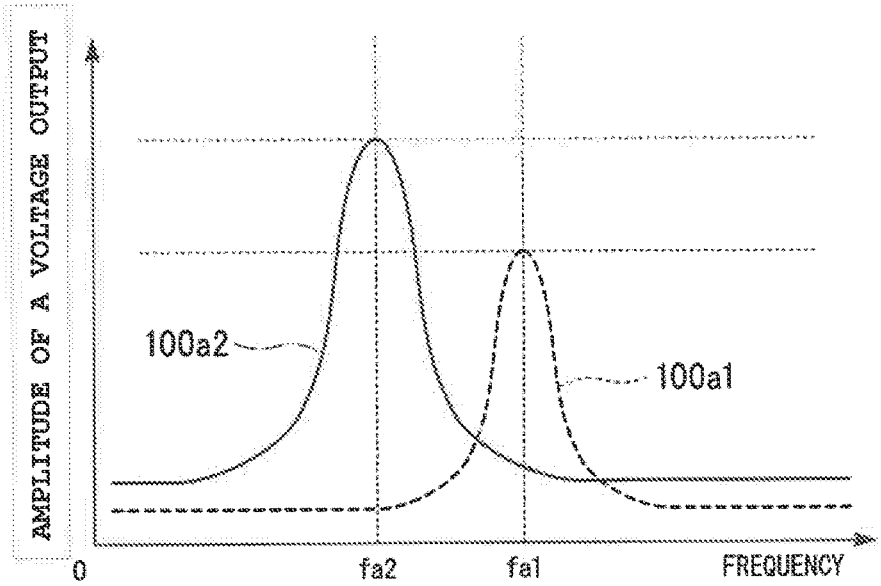
FIG. 4 is a diagram illustrating a relationship between a frequency of a high-frequency signal input to the magnetoresistance effect device and an amplitude of a voltage output therefrom when an external magnetic field applied to the magnetoresistance effect element is constant.

The ferromagnetic resonance frequency may be modulated by changing a current density of a direct current which is applied from the power source 41 to the magnetoresistance effect element 10. FIG. 4 is a diagram illustrating a relationship between the frequency of a high-frequency signal input to the magnetoresistance effect device 100 and the amplitude of a voltage output therefrom when an external magnetic field applied to the magnetoresistance effect element 10 is constant.

The output voltage output from the second port 2 of the magnetoresistance effect device 100 is expressed by a product of a resistance value fluctuating in the magnetoresistance effect element 10 and a direct current flowing in the magnetoresistance effect element 10. When the direct current flowing in the magnetoresistance effect element increases, the amplitude of the output voltage (the output signal) increases in level.

When an amount of direct current flowing in the magnetoresistance effect element 10 varies, the magnetization state in the magnetization free layer 12 varies, and the magnitudes of the anisotropic magnetic field $H_k$, the demagnetizing field $H_D$, and the exchange coupling magnetic field $H_{EX}$ in the magnetization free layer 12 vary. As a result, when the direct current increases, the ferromagnetic resonance frequency is lowered. That is, as illustrated in FIG. 4, when the amount of direct current increases, the ferromagnetic resonance frequency shifts from the plotted line 100*a*1 to the plotted line 100*a*2. In this way, it is possible to modulate the ferromagnetic resonance frequency by changing the amount of current applied from the direct current source 41 to the magnetoresistance effect element 10.

An example in which the magnetoresistance effect device is used as a high-frequency filter has been described above, but the magnetoresistance effect device may be used as a high-frequency device such as an isolator, a phase shifter, an amplifier (Amp).

When the magnetoresistance effect device is used as an isolator, a signal is input from the second port 2. Even when a signal is input from the second port 2, a signal is not output from the first port 1 and thus the magnetoresistance effect device serves as an isolator.

When the magnetoresistance effect device is used as a phase shifter, attention is paid to an arbitrary frequency point in a frequency band which is output when the output frequency band varies. When the output frequency band varies, the phase at a specific frequency also varies and thus the magnetoresistance effect device serves as a phase shifter.

When the magnetoresistance effect device is used as an amplifier, the change in resistance value of the magnetoresistance effect element 10 is increased. The change in resistance value of the magnetoresistance effect element 10 is increased by: setting the direct current input from the power source 41 to be a predetermined magnitude or more; or increasing the high-frequency magnetic field applied from the first signal line 20 to the magnetoresistance effect element 10. When the change in resistance value of the magnetoresistance effect element 10 increases, a signal output from the second port 2 becomes higher than the signal input from the first port 1 and thus the magnetoresistance effect device serves as an amplifier.

As described above, the magnetoresistance effect device 100 according to the first embodiment can serve as a high-frequency device such as a high-frequency filter, an isolator, a phase shifter, or an amplifier.

The magnetoresistance effect device 100 according to the first embodiment includes a plurality of high-frequency magnetic field application areas (the first line 21 and the second line 23 in FIG. 2) that apply a high-frequency magnetic field to the magnetoresistance effect element 10. Since the high-frequency magnetic fields generated from the high-frequency magnetic field application areas reinforce each other, it is possible to apply a high-level high-frequency magnetic field to the magnetoresistance effect element 10. As a result, the change in resistance value of the magnetoresistance effect element 10 increases and the magnetoresistance effect device 100 with excellent output characteristics is obtained.

(Second Embodiment)

Figure 5:
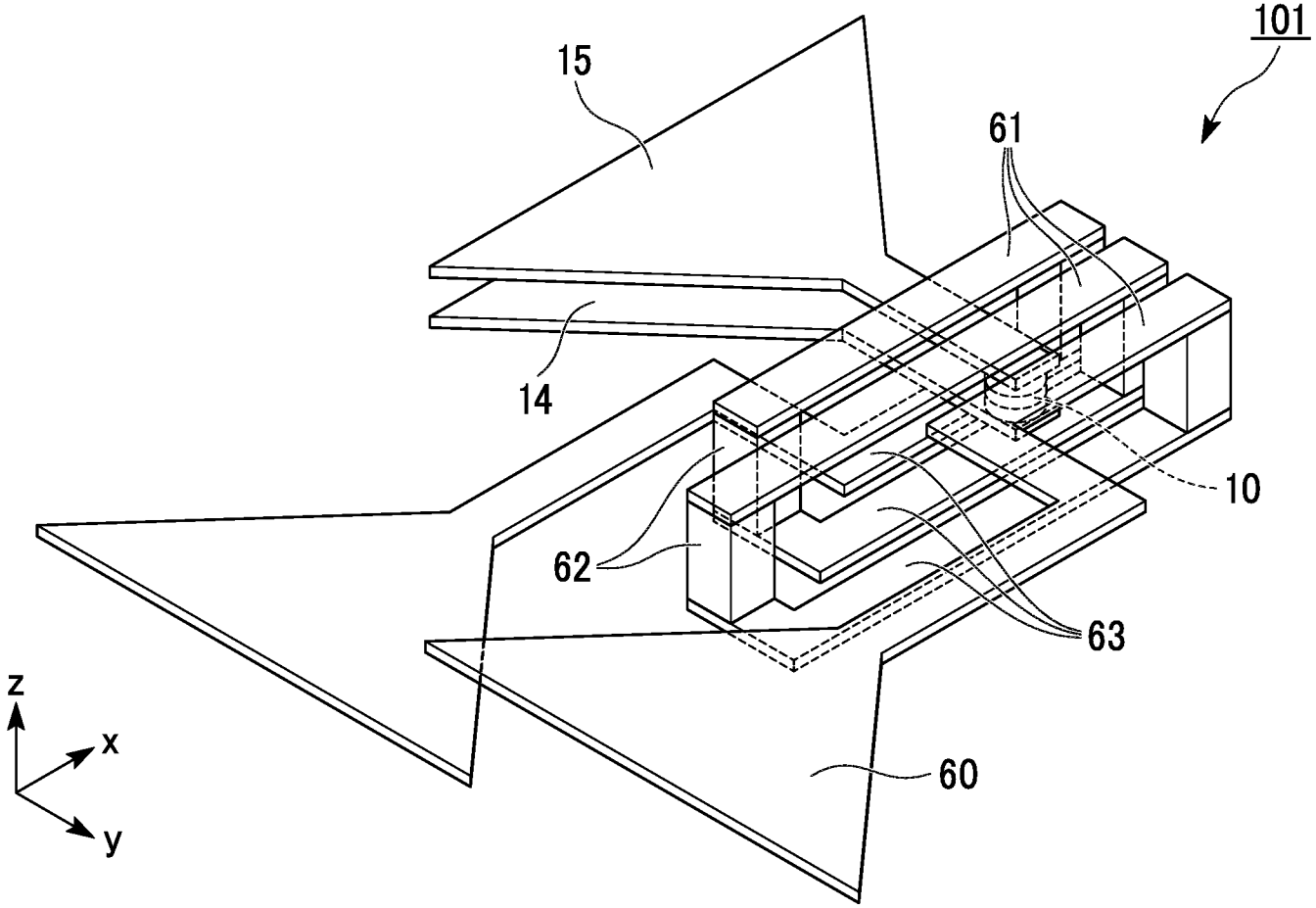
FIG. 5 is a schematic perspective view of the vicinity of a magnetoresistance effect element of a magnetoresistance effect device according to a second embodiment.

FIG. 5 is a schematic perspective view of the vicinity of a magnetoresistance effect element 10 of a magnetoresistance effect device 101 according to a second embodiment. The magnetoresistance effect device 101 according to the second embodiment is the same as the magnetoresistance effect device 100 according to the first embodiment in that a first signal line 60 surrounds a magnetoresistance effect element 10 when the magnetoresistance effect element 10 is viewed in the y direction, but is different from the magnetoresistance effect device 100 according to the first embodiment in that the first signal line 60 is wound around an axis extending in the y direction through the magnetoresistance effect element 10. In FIG. 5, the same elements as in the magnetoresistance effect device 100 according to the first embodiment are referred to by the same reference signs.

As illustrated in FIG. 5, the first signal line 60 includes a plurality of first lines 61 that extend in the x direction at a position in the +z direction of the magnetoresistance effect element 10 and a plurality of second lines 63 that are disposed at positions facing the first lines 61 with the magnetoresistance effect element 10 interposed therebetween. The first lines 61 and the second lines 63 are connected by via wirings 62 such that the magnetoresistance effect element 10 is wound around an axis extending in the y direction.

A high-frequency current flows in one direction in the first signal line 60. Accordingly, the direction of a high-frequency current flowing in the first lines 61 and the direction of a high-frequency current flowing in the second lines 63 are antiparallel to each other. The plurality of first lines 61 apply a magnetic field in the −y direction to the magnetoresistance effect element 10 at a certain moment on the basis of the Ampere's law. Similarly, the plurality of second lines 63 apply a magnetic field in the −y direction to the magnetoresistance effect element 10 at a certain moment. That is, the magnetic field generated in the first lines 61 and the magnetic field generated in the second lines 63 overlap each other at the position of the magnetoresistance effect element 10 and reinforce each other.

Here, the first lines 61 and the second lines 63 are parallel to the y direction. Accordingly, the directions of the magnetic fields which some of the first lines 61 and the second lines 63 apply to the magnetoresistance effect element 10 at a certain moment are strictly inclined with respect to the −y direction. In this case, the magnetic fields have components in the y direction and thus can be said to reinforce each other.

That is, "the magnetic fields reinforce each other" means that the magnetic fields have components in the same direction, and the magnetic field can be said to reinforce each other when an angle formed by a direction of a vector at a predetermined position of a magnetic field generated from one source and a direction of a vector at a predetermined position of a magnetic field generated from another source is an acute angle.

Since the magnetoresistance effect device 101 according to the second embodiment has the same functions as the magnetoresistance effect device 100 according to the first embodiment, the magnetoresistance effect device 101 according to the second embodiment can also serve as a high-frequency device such as a high-frequency filter, an isolator, a phase shifter, or an amplifier.

The magnetoresistance effect device 101 according to the second embodiment includes a plurality of high-frequency magnetic field application areas (a plurality of first lines 61 and a plurality of second lines 63 in FIG. 5) that apply a high-frequency magnetic field to the magnetoresistance effect element 10. Since the high-frequency magnetic fields generated from the high-frequency magnetic field application areas reinforce each other, it is possible to apply a high-level high-frequency magnetic field to the magnetoresistance effect element 10. As a result, the change in resistance value of the magnetoresistance effect element 10 increases and the magnetoresistance effect device 101 with excellent output characteristics is obtained.

(Third Embodiment)

Figure 6:
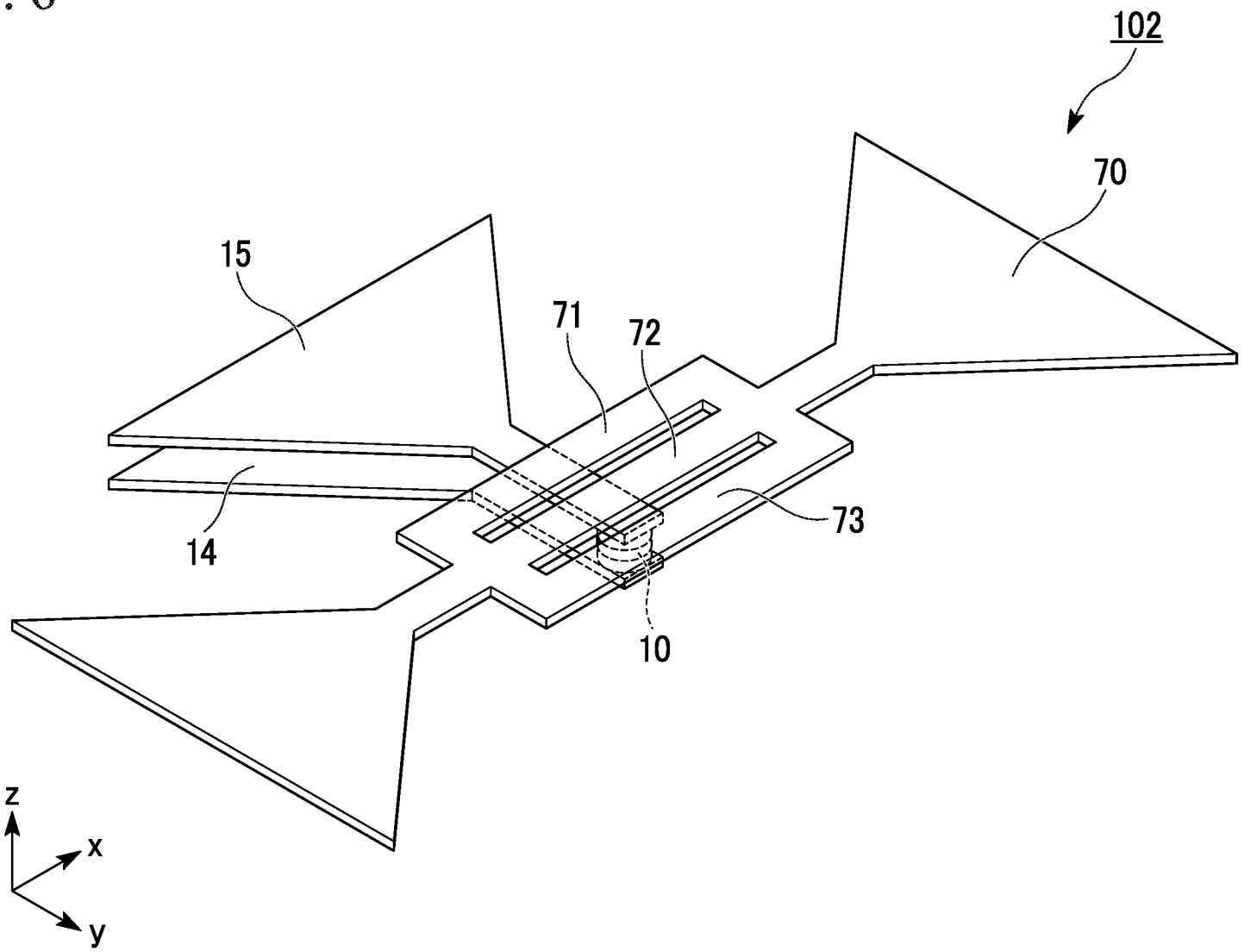
FIG. 6 is a schematic perspective view of the vicinity of a magnetoresistance effect element of a magnetoresistance effect device according to a third embodiment.

FIG. 6 is a schematic perspective view of the vicinity of a magnetoresistance effect element 10 of a magnetoresistance effect device 102 according to a third embodiment. The magnetoresistance effect device 102 according to the third embodiment is different from the magnetoresistance effect device 100 according to the first embodiment in that the first signal line 70 branches into a plurality of signal lines 71, 72, and 73 in the middle thereof and the branched signal lines 71, 72, and 73 are located on the same surface side (the +z direction) with respect to the magnetoresistance effect element 10. In FIG. 6, the same elements as in the magnetoresistance effect device 100 according to the first embodiment are referred to by the same reference signs.

As illustrated in FIG. 6, the first signal line 70 extends in the x direction at a position in the +z direction of the magnetoresistance effect element 10. The first signal line 70 branches into a plurality of signal lines 71, 72, and 73 in the middle way and then the branched signal lines are merged. The plurality of signal lines 71, 72, and 73 are disposed in parallel at an overlapping position when the magnetoresistance effect element 10 is viewed in the z direction.

A high-frequency current flows in one direction in the first signal line 70. Accordingly, the directions of the high-frequency currents flowing in the plurality of signal lines 71, 72, and 73 are the same. The plurality of signal lines 71, 72, and 73 apply a magnetic field in the y direction to the magnetoresistance effect element 10 at a certain moment on the basis of the Ampere's law. That is, the magnetic fields generated in the signal lines 71, 72, and 73 overlap each other at the position of the magnetoresistance effect element 10 and reinforce each other.

Since the magnetoresistance effect device 102 according to the third embodiment has the same functions as the magnetoresistance effect device 100 according to the first embodiment, the magnetoresistance effect device 102 according to the third embodiment can also serve as a high-frequency device such as a high-frequency filter, an isolator, a phase shifter, or an amplifier.

The magnetoresistance effect device 102 according to the third embodiment includes a plurality of high-frequency magnetic field application areas (a plurality of signal lines 71, 72, and 73 in FIG. 6) that apply a high-frequency magnetic field to the magnetoresistance effect element 10. Since the high-frequency magnetic fields generated from the high-frequency magnetic field application areas reinforce each other, it is possible to apply a high-level high-frequency magnetic field to the magnetoresistance effect element 10. As a result, the change in resistance value of the magnetoresistance effect element 10 increases and the magnetoresistance effect device 102 with excellent output characteristics is obtained.

In the magnetoresistance effect device 102 according to the third embodiment, the first signal line 70 branches into three signal lines 71, 72, and 73, but the number of branched signal lines is not limited thereto and the first signal line may branch into two signal lines or may branch into signal lines more than three.

(Fourth Embodiment)

Figure 7:
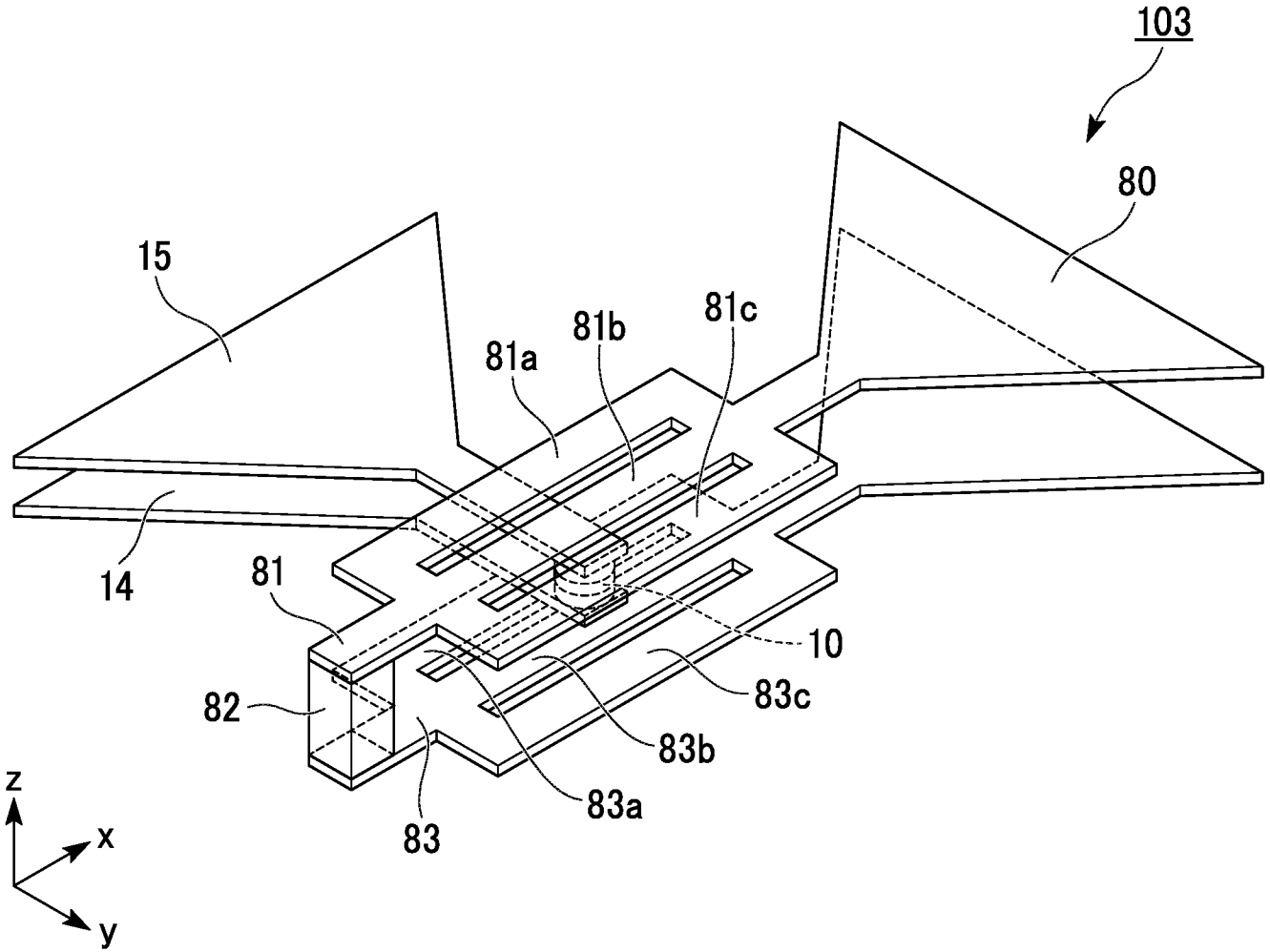
FIG. 7 is a schematic perspective view of the vicinity of a magnetoresistance effect element of a magnetoresistance effect device according to a fourth embodiment.

FIG. 7 is a schematic perspective view of the vicinity of a magnetoresistance effect element 10 of a magnetoresistance effect device 103 according to a fourth embodiment. The magnetoresistance effect device 103 according to the fourth embodiment is the same as the magnetoresistance effect device 100 according to the first embodiment in that a first signal line 80 surrounds a magnetoresistance effect element 10 when the magnetoresistance effect element 10 is viewed in the y direction. On the other hand, the magnetoresistance effect device 103 according to the fourth embodiment is different from the magnetoresistance effect device 100 according to the first embodiment in that the first signal line 80 branches in the middle way. In FIG. 7, the same elements as in the magnetoresistance effect device 100 according to the first embodiment are referred to by the same reference signs.

As illustrated in FIG. 7, the first signal line 80 includes a first line 81 that extends in the x direction at a position in the +z direction of the magnetoresistance effect element 10 and a second line 83 that is disposed at a position facing the first line 81 with the magnetoresistance effect element 10 interposed therebetween. The first line 81 and the second line 83 are connected to a via wiring 82.

The first line 81 branches into three signal lines 81*a*, 81*b*, and 81*c* and then merges, and the second line 83 also branches into three signal lines 83*a*, 83*b*, and 83*c* and then merges. The three signal lines 81*a*, 81*b*, and 81*c* into which the first line 81 has branched are disposed at a position in the +z direction of the magnetoresistance effect element 10, and the three signal lines 83*a*, 83*b*, and 83*c* into which the second line 83 has branched are disposed at a position in the −z direction of the magnetoresistance effect element 10.

A high-frequency current flows in one direction in the first signal line 80. Accordingly, the direction of a high-frequency current flowing in the first lines 81 and the direction of a high-frequency current flowing in the second lines 83 are antiparallel to each other. On the other hand, the directions of the high-frequency currents flowing in the three signal lines 81*a*, 81*b*, and 81*c* into which the first line 81 has branched are the same direction, and the directions of the high-frequency currents flowing in the three signal lines 83*a*, 83*b*, and 83*c* into which the second line 83 has branched are the same direction. That is, the high-frequency currents flow in the same direction in the signal lines which are located on the same surface side with respect to the magnetoresistance effect element 10.

The three signal lines 81*a*, 81*b*, and 81*c* of the first line 81 apply a magnetic field in the y direction to the magnetoresistance effect element 10 at a certain moment on the basis of the Ampere's law. Similarly, the three signal lines 83*a*, 83*b*, and 83*c* of the second line 83 apply a magnetic field in the y direction to the magnetoresistance effect element 10 at a certain moment. That is, the magnetic field generated in the first line 81 and the magnetic field generated in the second line 83 overlap each other at the position of the magnetoresistance effect element 10 and reinforce each other.

Since the magnetoresistance effect device 103 according to the fourth embodiment has the same functions as the magnetoresistance effect device 100 according to the first embodiment, the magnetoresistance effect device 103 according to the fourth embodiment can also serve as a high-frequency device such as a high-frequency filter, an isolator, a phase shifter, or an amplifier.

The magnetoresistance effect device 103 according to the fourth embodiment includes a plurality of high-frequency magnetic field application areas (a plurality of signal lines 81*a*, 81*b*, and 81*c* of the first line 81 and a plurality of signal lines 83*a*, 83*b*, and 83*c* of the second line 83 in FIG. 7) that apply a high-frequency magnetic field to the magnetoresistance effect element 10. Since the high-frequency magnetic fields generated from the high-frequency magnetic field application areas reinforce each other, it is possible to apply a high-level high-frequency magnetic field to the magnetoresistance effect element 10. As a result, the change in resistance value of the magnetoresistance effect element 10 increases and the magnetoresistance effect device 103 with excellent output characteristics is obtained.

In the magnetoresistance effect device 103 according to the fourth embodiment, the number of branched signal lines of the first line 81 and the second line 83 is not limited to the example illustrated in FIG. 7, and the signal lines may branch into two signal lines or may branch into signal lines more than three. The number of branched signal lines of the first line 81 and the number of branched signal lines of the second line 83 may be different from each other.

(Fifth Embodiment)

Figure 8:
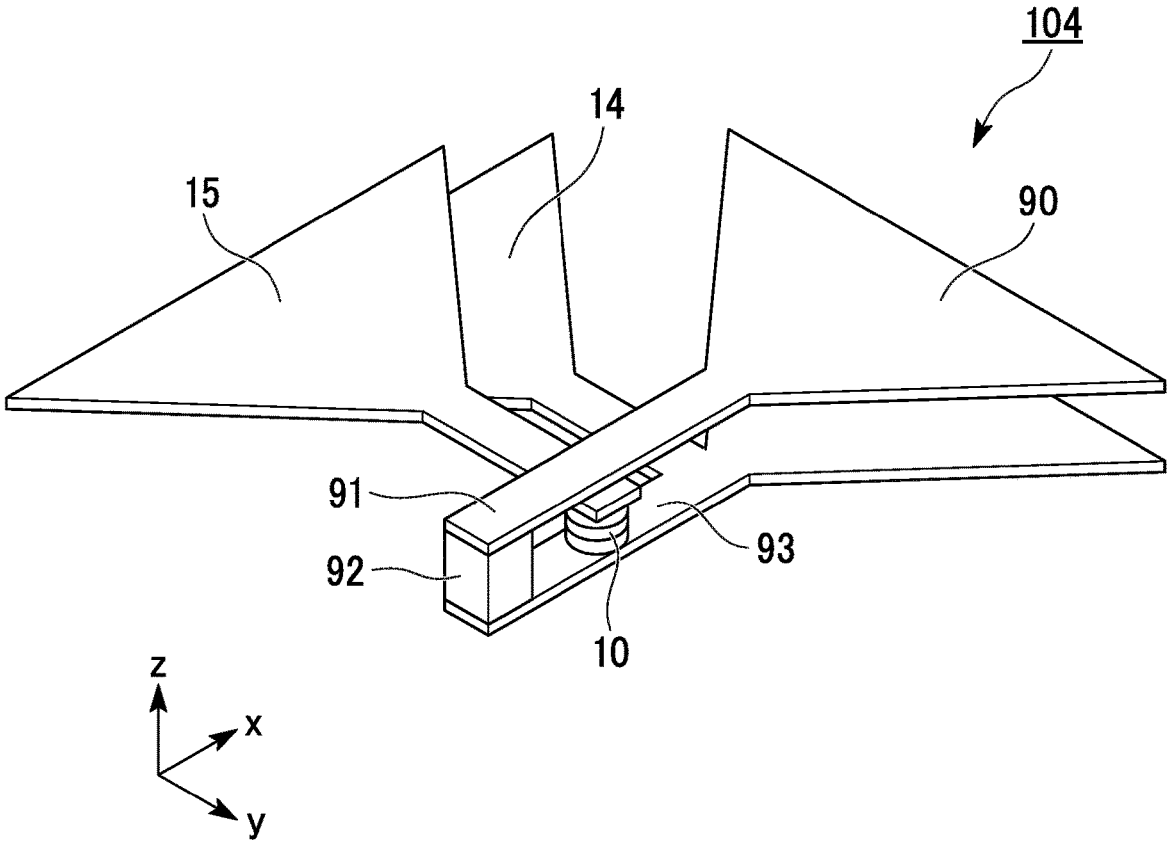
FIG. 8 is a schematic perspective view of the vicinity of a magnetoresistance effect element of a magnetoresistance effect device according to a fifth embodiment.

FIG. 8 is a schematic perspective view of the vicinity of a magnetoresistance effect element 10 of a magnetoresistance effect device 104 according to a fifth embodiment. The magnetoresistance effect device 104 according to the fifth embodiment is the same as the magnetoresistance effect device 100 according to the first embodiment in that a first signal line 90 surrounds a magnetoresistance effect element 10 when the magnetoresistance effect element 10 is viewed in the y direction. On the other hand, the magnetoresistance effect device 104 according to the fifth embodiment is different from the magnetoresistance effect device 100 according to the first embodiment in that a part of the first signal line 90 also serves as a lower electrode 14. In FIG. 8, the same elements as in the magnetoresistance effect device 100 according to the first embodiment are referred to by the same reference signs.

As illustrated in FIG. 8, the first signal line 90 includes a first line 91 that extends in the x direction at a position in the +z direction of the magnetoresistance effect element 10 and a second line 93 that is disposed at a position facing the first line 91 with the magnetoresistance effect element 10 interposed therebetween. The first line 91 and the second line 93 are connected to a via wiring 92. The second line 93 is connected to the magnetoresistance effect element 10 and also serves as a lower electrode 14 that causes a current to flow in the lamination direction of the magnetoresistance effect element 10.

A high-frequency signal input from the first port 1 (see FIG. 1) flows sequentially through the first line 91, the via wiring 92, and the second line 93 in the first signal line 90. Accordingly, the direction of the high-frequency current flowing in the first line 91 and the direction of the high-frequency current flowing in the second line 93 are antiparallel to each other. The directions of the magnetic fields (the y direction) which are applied to the magnetoresistance effect element 10 from the first line 91 and the second line 93 are the same on the basis of the Ampere's law, and the magnetic fields reinforce each other.

On the other hand, when a signal is output, a current is caused to flow in the lamination direction of the magnetoresistance effect element 10, and a change in resistance value of the magnetoresistance effect element 10 is read from the second ports 2 (see FIG. 1). A direct current for reading the change in resistance value flows through the upper electrode 15, the magnetoresistance effect element 10, and the lower electrode 14 (the second line 93) and is output from the second port 2.

When the first signal line 90 also serves as the lower electrode 14 of the magnetoresistance effect element 10, the number of lines in the magnetoresistance effect device 104 decreases. The magnetoresistance effect device 104 is manufactured using a photolithography method or the like. Accordingly, when the number of lines decreases, the number of manufacturing processes decreases greatly and it is thus possible to reduce the manufacturing time and the manufacturing cost of the magnetoresistance effect device 104. The number of components of the magnetoresistance effect device 104 decreases and a degree of integration of the magnetoresistance effect device 104 increases.

The resistance value in the lamination direction of the magnetoresistance effect element 10 is preferably greater than the resistance value of the first signal line 90. A signal input from the first port 1 is prevented from flowing to the upper electrode 15 via the magnetoresistance effect element 10. The first signal line 90 is formed of a material having an excellent conductivity such as a metal, and the resistance value of the first signal line 90 is about several Ω. Specifically, the resistance value in the lamination direction of the magnetoresistance effect element 10 is preferably 20 Ω or more.

On the other hand, a part of the high-frequency current flowing in the first signal line 90 may flow to the upper electrode 15 side. In this case, the magnetization of the magnetization free layer 12 of the magnetoresistance effect element 10 fluctuates due to a magnetic field generated from the high-frequency current flowing in the first signal line 90 and a spin transfer torque generated from the high-frequency current flowing in the lamination direction of the magnetoresistance effect element 10.

The resistance value of the first line 91 or the via wiring 92 is preferably set to be greater than the resistance value of the second line 93. It is possible to prevent a direct current for reading the change in resistance value from flowing in the via wiring 92 and the first line 91. That is, by setting the resistance value of the first line 91 or the via wiring 92 to be greater than the resistance value of the second line 93, it is possible to curb deterioration of the signal output from the second port 2.

The configuration in which the first signal line 90 also serves as the lower electrode 14 of the magnetoresistance effect element 10 has been described above, but a configuration in which the flowing direction of the direct current is reversed and the first signal line 90 also serves as the upper electrode 15 of the magnetoresistance effect element 10 may be employed.

Since the magnetoresistance effect device 104 according to the fifth embodiment has the same functions as the magnetoresistance effect device 100 according to the first embodiment, the magnetoresistance effect device 104 according to the fifth embodiment can also serve as a high-frequency device such as a high-frequency filter, an isolator, a phase shifter, or an amplifier.

The magnetoresistance effect device 104 according to the fifth embodiment includes a plurality of high-frequency magnetic field application areas (the first line 91 and the second line 93 in FIG. 8) that apply a high-frequency magnetic field to the magnetoresistance effect element 10. Since the high-frequency magnetic fields generated from the high-frequency magnetic field application areas reinforce each other, it is possible to apply a high-level high-frequency magnetic field to the magnetoresistance effect element 10. As a result, the change in resistance value of the magnetoresistance effect element 10 increases and the magnetoresistance effect device 104 with excellent output characteristics is obtained.

In the magnetoresistance effect device 104 according to the fifth embodiment, since the first signal line 90 also serves as the lower electrode 14 of the magnetoresistance effect element 10, the number of components thereof is small, and the magnetoresistance effect device 104 can be easily manufactured and has a high degree of integration.

(Sixth Embodiment)

Figure 9:
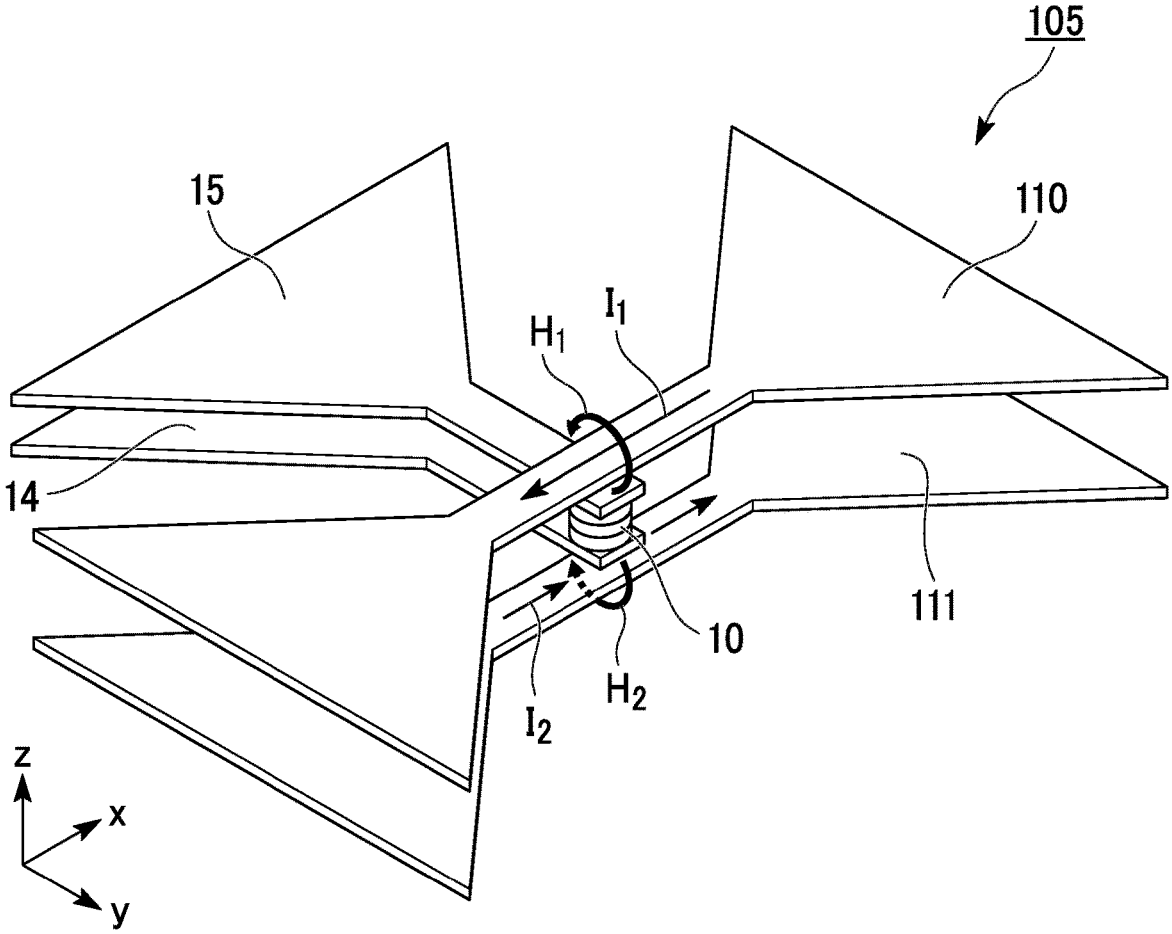
FIG. 9 is a schematic perspective view of the vicinity of a magnetoresistance effect element of a magnetoresistance effect device according to a sixth embodiment.

FIG. 9 is a schematic perspective view of the vicinity of a magnetoresistance effect element 10 of a magnetoresistance effect device 105 according to a sixth embodiment. The magnetoresistance effect device 105 according to the sixth embodiment is different from the magnetoresistance effect device 100 according to the first embodiment in that the first signal line does not include a plurality of high-frequency magnetic field application areas, but a plurality of first signal lines are provided. In FIG. 9, the same elements as in the magnetoresistance effect device 100 according to the first embodiment are referred to by the same reference signs.

The magnetoresistance effect device 105 according to the sixth embodiment includes a first signal line 110 that extends in the x direction at a position in the +z direction of the magnetoresistance effect element 10 and a first signal line 111 that extends in the x direction at a position in the −z direction of the magnetoresistance effect element 10. The direction of a high-frequency current flowing in the first signal line 110 and the direction of a high-frequency current flowing in the first signal line 111 are different from each other.

Both the first signal line 110 and the first signal line 111 apply magnetic fields in the +y direction of the magnetoresistance effect element 10 on the basis of the Ampere's law. That is, the magnetic fields generated by the first signal lines 110 and 111 reinforce each other at the position of the magnetoresistance effect element 10.

In the magnetoresistance effect device 105 according to the sixth embodiment, the first signal lines 110 and 111 that apply high-frequency magnetic fields to the magnetoresistance effect element 10 are located at positions at which the high-frequency magnetic fields generated therefrom reinforce each other, and can apply a high-level high-frequency magnetic field to the magnetoresistance effect element 10. As a result, the change in resistance value of the magnetoresistance effect element 10 increases and a magnetoresistance effect device 105 having excellent output characteristics is obtained. On the other hand, the number of lines of the magnetoresistance effect device 105 is large and thus it is difficult to enhance a degree of integration.

The invention is not limited to the configurations of the magnetoresistance effect devices according to the embodiments. The magnetoresistance effect device has only to have a configuration in which the first signal line includes a plurality of high-frequency magnetic field application areas that apply a high-frequency magnetic field to the magnetoresistance effect element and the plurality of high-frequency magnetic field application areas in the first signal line are disposed at positions at which the high-frequency magnetic fields generated from the high-frequency magnetic field application areas reinforce each other in the magnetoresistance effect element.

For example, the first signal line is not limited to the configuration illustrated in FIG. 2 in which the first signal line surrounds the magnetoresistance effect element 10 when the magnetoresistance effect element is viewed in the y direction, but may have a configuration in which the first signal line surrounds the magnetoresistance effect element 10 when viewed in an arbitrary direction.

A plurality of high-frequency magnetic field application areas do not need to be disposed at equal distance from the magnetoresistance effect element 10, but may be disposed at different distances therefrom.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

EXPLANATION OF REFERENCES

1 First port
2 Second port

10 Magnetoresistance effect element
11 Magnetization fixed layer
12 Magnetization free layer
13 Spacer layer
14 Lower electrode
15 Upper electrode
20, 60, 70, 90, 110, 111 First signal line
21, 61, 81, 91 First line
22, 62, 82, 92 Via wiring
23, 63, 83, 93 Second line
30 Second signal line
31 Third signal line
40 Direct current application terminal
41 Direct current application source
42 Inductor
71, 72, 73, 81*a*, 81*b*, 81*c*, 83*a*, 83*b*, 83*c* Signal line
G Ground
100, 101, 102, 103, 104, 105 Magnetoresistance effect device

What is claimed is:

1. A magnetoresistance effect device, comprising:
a first port configured for an input signal;
a second port configured for an output signal;
a magnetoresistance effect element including a first ferromagnetic layer, a second ferromagnetic layer, and a spacer layer that is interposed between the first ferromagnetic layer and the second ferromagnetic layer;
a first signal line which is connected to the first port, a high frequency current corresponding to the input signal from the first port flowing through the first signal line, and the first signal line being configured to apply a high frequency magnetic field to the magnetoresistance effect element;
a second signal line that connects the second port and the magnetoresistance effect element to each other; and
a direct current application terminal that is capable of being connected to a power supply configured to apply a direct current or a direct current voltage in a lamination direction of the magnetoresistance effect element,
wherein the first signal line includes a plurality of high-frequency magnetic field application areas capable of applying a respective high-frequency magnetic field to the magnetoresistance effect element, and
the plurality of high-frequency magnetic field application areas in the first signal line are disposed at positions at which the respective high-frequency magnetic fields generated in the high-frequency magnetic field application areas reinforce each other in the magnetoresistance effect element.

2. The magnetoresistance effect device according to claim 1, wherein
the first signal line surrounds the magnetoresistance effect element as the magnetoresistance effect element being viewed in a predetermined direction, and
at least two high-frequency magnetic field application areas of the plurality of high-frequency magnetic field application areas are located at positions facing each other with respect to the magnetoresistance effect element.

3. The magnetoresistance effect device according to claim 2, wherein the first signal line is wound around an axis extending in the predetermined direction through the magnetoresistance effect element.

4. The magnetoresistance effect device according to claim 3, wherein
the first signal line branches into a plurality of signal lines, and
all the signal lines in which the high-frequency current flows in a same direction among the plurality of branched signal lines are disposed on a same surface side of the magnetoresistance effect element.

5. The magnetoresistance effect device according to claim 4, wherein a part of the first signal line is configured as an upper electrode or a lower electrode configured to apply the direct current or the direct voltage input from the direct current application terminal in the lamination direction of the magnetoresistance effect element.

6. The magnetoresistance effect device according to claim 5, wherein a resistance value of the magnetoresistance effect element is 20Ω or more.

7. The magnetoresistance effect device according to claim 2, wherein a part of the first signal line is configured as an upper electrode or a lower electrode configured to apply the direct current or the direct voltage input from the direct current application terminal in the lamination direction of the magnetoresistance effect element.

8. The magnetoresistance effect device according to claim 7, wherein a resistance value of the magnetoresistance effect element is 20Ω or more.

9. The magnetoresistance effect device according to claim 2, wherein
the first signal line branches into a plurality of signal lines, and
all the signal lines in which the high-frequency current flows in a same direction among the plurality of branched signal lines are disposed on a same surface side of the magnetoresistance effect element.

10. The magnetoresistance effect device according to claim 9, wherein a part of the first signal line is configured as an upper electrode or a lower electrode configured to apply the direct current or the direct voltage input from the direct current application terminal in the lamination direction of the magnetoresistance effect element.

11. The magnetoresistance effect device according to claim 10, wherein a resistance value of the magnetoresistance effect element is 20Ω or more.

12. The magnetoresistance effect device according to claim 3, wherein a part of the first signal line is configured as an upper electrode or a lower electrode configured to apply the direct current or the direct voltage input from the direct current application terminal in the lamination direction of the magnetoresistance effect element.

13. The magnetoresistance effect device according to claim 12, wherein a resistance value of the magnetoresistance effect element is 20Ω or more.

14. The magnetoresistance effect device according to claim 1, wherein the first signal line branches into a plurality of signal lines, and all the signal lines in which the high-frequency current flows in a same direction among the plurality of branched signal lines are disposed on a same surface side of the magnetoresistance effect element.

15. The magnetoresistance effect device according to claim 14, wherein a part of the first signal line is configured as an upper electrode or a lower electrode configured to apply the direct current or the direct voltage input from the direct current application terminal in the lamination direction of the magnetoresistance effect element.

16. The magnetoresistance effect device according to claim 15, wherein a resistance value of the magnetoresistance effect element is 20Ω or more.

17. The magnetoresistance effect device according to claim 1, further comprising a magnetic field application mechanism configured to apply an external magnetic field to the magnetoresistance effect element and to modulate a resonance frequency of the magnetoresistance effect element.

18. A high-frequency device employing the magnetoresistance effect device according to claim 1.

19. The magnetoresistance effect device according to claim 1, wherein a part of the first signal line is configured as an upper electrode or a lower electrode configured to apply the direct current or the direct voltage input from the direct current application terminal in the lamination direction of the magnetoresistance effect element.

20. The magnetoresistance effect device according to claim 19, wherein a resistance value of the magnetoresistance effect element is 20Ω or more.

* * * * *